US008689864B2

(12) United States Patent
Reid

(10) Patent No.: US 8,689,864 B2
(45) Date of Patent: Apr. 8, 2014

(54) ACTIVATION DEVICE

(75) Inventor: Steve Reid, Aberdeen (GB)

(73) Assignee: Petrowell Limited, Aberdeen (GB)

( * ) Notice: Subject to any disclaimer, the term of this patent is extended or adjusted under 35 U.S.C. 154(b) by 173 days.

(21) Appl. No.: 12/665,641

(22) PCT Filed: Jun. 17, 2008

(86) PCT No.: PCT/GB2008/002042
§ 371 (c)(1),
(2), (4) Date: Mar. 1, 2010

(87) PCT Pub. No.: WO2008/155526
PCT Pub. Date: Dec. 24, 2008

(65) Prior Publication Data

US 2011/0100648 A1 May 5, 2011

(30) Foreign Application Priority Data

Jun. 20, 2007 (GB) ..... 0711871.4

(51) Int. Cl.
*E21B 23/00* (2006.01)

(52) U.S. Cl.
USPC ..... 166/242.7; 166/387; 166/242.1

(58) Field of Classification Search
USPC ..... 166/242.1, 242.7, 381, 387; 175/320, 175/322
See application file for complete search history.

(56) References Cited

U.S. PATENT DOCUMENTS

| | | | | |
|---|---|---|---|---|
| 643,358 | A | 2/1900 | Konold | |
| 1,896,107 | A * | 2/1933 | Simmons | 175/97 |
| 2,009,322 | A | 7/1935 | Emil | |
| 2,181,748 | A | 11/1939 | Thaheld | |
| 2,498,791 | A | 2/1950 | Clark | |
| 2,546,377 | A | 3/1951 | Turechek | |
| 2,738,018 | A | 3/1956 | Lynes | |
| 2,832,418 | A | 4/1958 | Baker | |
| 3,066,738 | A | 12/1962 | Myers | |
| 3,087,552 | A | 4/1963 | Graham | |
| 3,167,127 | A | 1/1965 | Sizer | |
| 3,167,128 | A | 1/1965 | Sutliff | |
| 3,283,821 | A | 11/1966 | Brown | |
| 3,342,268 | A | 9/1967 | Brown | |

(Continued)

FOREIGN PATENT DOCUMENTS

| | | |
|---|---|---|
| DE | 3812211 | 11/1989 |
| DE | 19827708 | 1/1999 |

(Continued)

OTHER PUBLICATIONS

International Search Report for PCT/GB2008/002042, Dated Jan. 13, 2009.

(Continued)

*Primary Examiner* — Giovanna Wright
*Assistant Examiner* — Richard Alker
(74) *Attorney, Agent, or Firm* — Wong, Cabello, Lutsch, Rutherford & Brucculeri LLP

(57) ABSTRACT

A device for activating a downhole tool is described. The device comprises a first elongate member defining a toothed surface portion, a second elongate member defining a toothed surface portion and at least one pinion arrangement The/each pinion arrangement engages the toothed surface portions of the first and second members such that movement of one member in a first direction results in movement of the other member in a second direction, opposite the first direction.

47 Claims, 7 Drawing Sheets

(56) References Cited

U.S. PATENT DOCUMENTS

| | | | | |
|---|---|---|---|---|
| 3,371,716 | A | 3/1968 | Current | |
| 3,482,889 | A | 12/1969 | Cochran | |
| 3,623,551 | A | 11/1971 | Randermann | |
| 3,722,588 | A | 3/1973 | Tamplen | |
| 3,729,170 | A | 4/1973 | Lewis et al. | |
| 3,889,750 | A | 6/1975 | Mullins | |
| 4,046,405 | A | 9/1977 | Bonds | |
| 4,127,168 | A | 11/1978 | Hanson | |
| 4,317,485 | A | 3/1982 | Ross | |
| 4,331,315 | A | 5/1982 | Geisow | |
| 4,346,919 | A | 8/1982 | Morrill | |
| 4,375,240 | A | 3/1983 | Baugh | |
| 4,588,030 | A | 5/1986 | Blizzard | |
| 4,917,187 | A | 4/1990 | Burns | |
| 2,230,447 | A | 2/1991 | Bassinger | |
| 5,058,684 | A | 10/1991 | Winslow | |
| 5,095,978 | A | 3/1992 | Akkerman | |
| 5,261,488 | A | 11/1993 | Gullet | |
| 5,542,473 | A | 8/1996 | Pringle | |
| 5,873,411 | A * | 2/1999 | Prentiss | 166/105 |
| 6,062,309 | A | 5/2000 | Gosse | |
| 6,315,041 | B1 | 11/2001 | Carlisle | |
| 6,345,669 | B1 * | 2/2002 | Buyers et al. | 166/381 |
| 7,690,424 | B2 | 4/2010 | MacLeod | |
| 2003/0000607 | A1 | 1/2003 | Jenner | |
| 2004/0055757 | A1 | 3/2004 | Beall | |
| 2004/0069502 | A1 * | 4/2004 | Luke | 166/387 |
| 2005/0199389 | A1 * | 9/2005 | Dallas et al. | 166/250.07 |
| 2005/0224227 | A1 | 10/2005 | Hendrie | |
| 2009/0308592 | A1 | 12/2009 | Mercer | |

FOREIGN PATENT DOCUMENTS

| | | |
|---|---|---|
| EP | 0468668 | 1/1992 |
| EP | 0485080 | 5/1992 |
| EP | 1408195 | 4/2004 |
| GB | 755082 | 8/1956 |
| GB | 1257790 | 12/1971 |
| GB | 1364054 | 8/1974 |
| GB | 2118659 | 11/1983 |
| GB | 2224526 | 5/1990 |
| GB | 2245624 | 8/1992 |
| GB | 2328230 | 2/1999 |
| GB | 2428708 | 2/2007 |
| WO | WO02/42672 | 5/2002 |
| WO | WO 2005/026494 | 3/2005 |
| WO | 2005121498 | 12/2005 |
| WO | WO2006/046075 | 5/2006 |
| WO | WO 2007/109878 | 10/2007 |

OTHER PUBLICATIONS

Written Opinion of the International Searching Authority for PCT/GB2008/002042.
Written Opinion of the International Searching Authority Re PCT/GB2007/001040.
International Search Report Re PCT/GB2007/001040.
International Preliminary Report of Patentability Re PCT/GB2007/001040.
International Search Report for PCT/GB2009/000730, Sep. 24, 2009.
Written Opinion for PCT/GB2009/000730, Sep. 18, 2010.
International Search Report for PCT/GB2009/000770, Oct. 8, 2009.
Written Opinion for PCT/GB2009/000770, Sep. 29, 2010.
Pct-gb2005-001391, Int'l Prelim. Report on Patentability, Jun. 23, 2005.
Pct-gb2005-001391, International Search Report, Jun. 23, 2005.
Pct-gb2005-001391, Written Opinion, Jun. 23, 2005.
Pct-gb2005-004200, Written Opinion, Apr. 10, 2006.
Pct-gb2005-004200, Int'l Prelim. Report on Patentability, May 1, 2007.
Pct-gb2005-004200, International Search Report, Jan. 11, 2006.
Pct-gb2005-003871, International Search Report, Nov. 17, 2005.
Office Action dated Mar. 30, 2009, Applicant's co-pending U.S. Appl. No. 11/816,421, Mar. 30, 2009.
Office Action dated Sep. 28, 2009, Applicant's co-pending U.S. Appl. No. 11/816,421, Sep. 28, 2009.
Foreign (UK) Office Action dated Nov. 1, 2005.
Pct-gb2005-003871, Written Opinion, Nov. 22, 2005.
Pctgb2006001297, Int'l Prelim. Report on Patentability and Written Opinion, Oct. 9, 2007.
Office Action dated May 29, 2009, Applicant's co-pending U.S. Appl. No. 11/909,820, May 29, 2009.
Office Action dated Feb. 17, 2010, Applicant's co-pending U.S. Appl. No. 11/909,820, Feb. 19, 2010.
Pctgb2007004372, Int'l Prelim. Report on Patentability and Written Opinion, May 19, 2009.
Pctgb2007004372, International Search Report, Jan. 23, 2008.
Pct-gb2008003883, Int'l Prelim. Report on Patentability and Written Opinion, May 25, 2010.
Pctgb2008003883, International Search Report, Mar. 26, 2009.
PCTGB200900048300, Int'l Prelim. Report on Patentability and Written Opinion, Aug. 24, 2010.
PCTGB200900048300, International Search Report, Sep. 28, 2009.
Office Action dated Oct. 7, 2010, Applicant's co-pending U.S. Appl. No. 11/909,820, Oct. 7, 2010.
Pursuant to MPEP § 2001.6(b) applicants bring the following co-pending or issued applications to the Examiner's attention: U.S. Appl. No. 12/866,495, U.S. Appl. No. 12/743,397, U.S. Appl. No. 12/743,505, U.S. Appl. No. 12/514,488, U.S. Appl. No. 12/294,078, U.S. Appl. No. 11/909,820, U.S. Appl. No. 11/816,421, U.S. Appl. No. 11/577,866, U.S. Appl. No. 11/570,335, U.S. Appl. No. 12/743,397, U.S. Appl. No. 12/866,495, U.S. Appl. No. 12/933,053, and U.S. Appl. No. 12/933,015.
PCT/GB2005/003871, International Preliminary Report on Patentability, Sep. 11, 2007.
PCT/GB2008/003957, International Preliminary Report on Patentability, Jun. 8, 2010.
PCT/GB2008/003957, International Search Report, Jul. 23, 2009.
Office Action in Applicant's co-pending application, U.S. Appl. No. 11/577,866, Aug. 25, 2010.

* cited by examiner

Section B-B

Detail C

ACTIVATION DEVICE

FIELD OF THE INVENTION

The present invention relates a device for activating a downhole tool, particularly, but not exclusively for activating a packer.

BACKGROUND TO THE INVENTION

Packers are used in downhole applications for sealing conduits. Recent packer developments have utilised cup seals which are formed in-situ. Cup seals are beneficial because once the cup seal has been moved into initial engagement with the wall of a conduit, the downhole pressure can be utilised to energise the cup seal and increase the sealing effect with the conduit wall. To isolate a section of conduit it is generally desirable to use the cup seals in pairs, the cup seals being opposed to each other with the open part of each cup facing away from the other.

Each cup seal is initially moved into engagement with the conduit wall by applying a force to the internal surface of the cup. This is generally achieved by moving a ramp into the cup. The ramp is moved by the application of a force from surface. As the cup seals face in opposite directions, the force must be applied in opposite directions to each seal.

Whilst it is relatively straightforward to apply a pull force from surface, it can be problematic applying a push force.

An object of at least one embodiment of the present invention is to obviate or mitigate at least one of the aforementioned problems.

SUMMARY OF THE INVENTION

According to a first aspect of the present invention there is provided a device for activating a downhole tool, the device comprising:

a first elongate member defining a toothed surface portion;

a second elongate member defining a toothed surface portion; and at least one pinion arrangement, the/each pinion arrangement engaging the toothed surface portions of the first and second members such that movement of one member in a first direction results in movement of the other member in a second direction, opposite the first direction.

Such an arrangement permits, in one embodiment, a pull force applied from the surface of an oil well to be converted to a push force at a location downhole.

Preferably, the at least one of the first and second members are tubular.

Preferably, both of the first and second members are tubular.

Preferably, the first member external diameter is less than the second member internal diameter.

Preferably, the first tubular member toothed surface portion is defined by an external surface.

Preferably, the second tubular member toothed surface portion is defined by an internal surface.

Preferably, the teeth on each toothed surface portion are arranged transverse to the direction of movement of the toothed surface.

Preferably, the toothed surface portions are opposed.

Preferably, the/each pinion arrangement is positioned between the first and second members.

Preferably, the/each pinion arrangement comprises a single pinion. Such a construction will result in equal movement of the first and second members.

Alternatively, the/each pinion arrangement comprises multiple pinions. Such a construction permits unequal movement of the first and second members. In some cases, for example, it may be desirable to have a large input movement in the first direction resulting in a smaller movement in the second direction to provide for fine adjustment.

In a further alternative, where the/each pinion arrangement comprises a single pinion, the/each pinion comprises an at least one first pinion region and an at least one second pinion region.

In one embodiment, the number of teeth on the/each first pinion region is different to the number of teeth on the/each second pinion region. This arrangement also permits unequal movement of the first and second members.

Preferably, the/each pinion tooth defines a profile comprising a plurality of portions.

Preferably, the profile of each pinion tooth or pinion tooth portion is linear.

Preferably, at least one of said linear profile portions is adapted to mesh with the first tubular member toothed surface.

Preferably, at least one other of said linear profile portions is adapted to mesh with the second tubular member toothed surface.

Preferably, adjacent linear profile portions are angled with respect to each other.

Preferably, each pinion tooth defines a profile comprising a plurality of linear portions, adjacent linear portions being angled with respect to one another.

Alternatively, the/each pinion defines a profile comprising at least one convex portion and at least one concave portion.

Preferably, the/each concave portion is adapted to mesh with the first tubular member toothed surface.

Preferably, the/each convex portion is adapted to mesh with the second tubular member toothed surface.

Preferably, each pinion tooth defines a profile comprising at least one convex portion and at least one concave portion.

In one embodiment, the teeth of the at least one first pinion region define a convex profile and the teeth of the at least one second pinion region define a concave profile.

Preferably, the/each pinion is adapted to rotate around a journal.

In one embodiment, where the/each pinion arrangement comprises a plurality of pinions, at least some of the pinions rotate around the same journal.

Preferably, the/each journal is fixed with respect to the first and second members.

Preferably, movement of one member equates to an equal movement of the other member.

Preferably, the device further comprises a pinion support adapted support the/each pinion arrangement.

Preferably, the pinion support defines at least one aperture, the/each, aperture adapted to receive a pinion arrangement.

Preferably, the pinion support is a tubular.

Preferably, the first member, the pinion support and the second member are arranged concentrically.

Preferably, the pinion support has an internal diameter greater than the external diameter of the first member.

Preferably, the pinion support has an external diameter less than the internal diameter of the second member.

Preferably, there are a plurality of pinion arrangements.

In one embodiment, there are six pinion arrangements.

Preferably, one of the first or second members is adapted to be engaged by a setting tool.

Preferably, the first member is adapted to be engaged by the setting tool.

Preferably, one of the first or second members is adapted to engage a packer. An embodiment of the present invention is adapted to engage a packer as described in the Applicant's co-pending application number PCT/GB2007/001040.

Preferably, the first and second members are adapted to move axially with respect to the pinion support.

According to a second aspect of the present invention there is provided a method of activating a tool, the method comprising the steps of:

applying a force to a first elongate member defining a toothed surface to move said first elongate member in a first direction, movement of the first elongate member rotating at least one pinion arrangement, rotation of the pinion arrangement moving a second elongate member in a second direction opposite the first direction, movement of the second member activating a tool.

According to a third aspect of the present invention there is provided a method of setting a pair of opposed seals in a wellbore, the method comprising the steps of:

engaging a setting apparatus with a first seal activation means;

applying a force in a first direction to the first seal setting means, the first seal activation means utilising the force to apply a force in the first direction to a first seal to set the first seal;

disengaging the setting apparatus from the first seal activation means;

engaging the setting apparatus with a second seal activation means;

applying a force in the first direction to the second seal activation means, the second seal activation means utilising the force to apply a force in a second direction, opposite the first direction, to a second seal to set the second seal.

Preferably, the second seal activation apparatus comprises:

a first elongate member defining a toothed surface portion;

a second elongate member defining a toothed surface portion; and at least one pinion arrangement, the/each pinion arrangement engaging the toothed surfaces of the first and second members such that movement of one member in a first direction results in movement of the other member in a second direction, opposite the first direction.

It will be understood that features of the first aspect may also be applicable to the second and/or third aspects.

BRIEF DESCRIPTION OF THE DRAWINGS

Embodiments of the present invention will now be described with reference to the attached drawings in which.

DETAILED DESCRIPTION OF THE DRAWINGS

Figure 1:
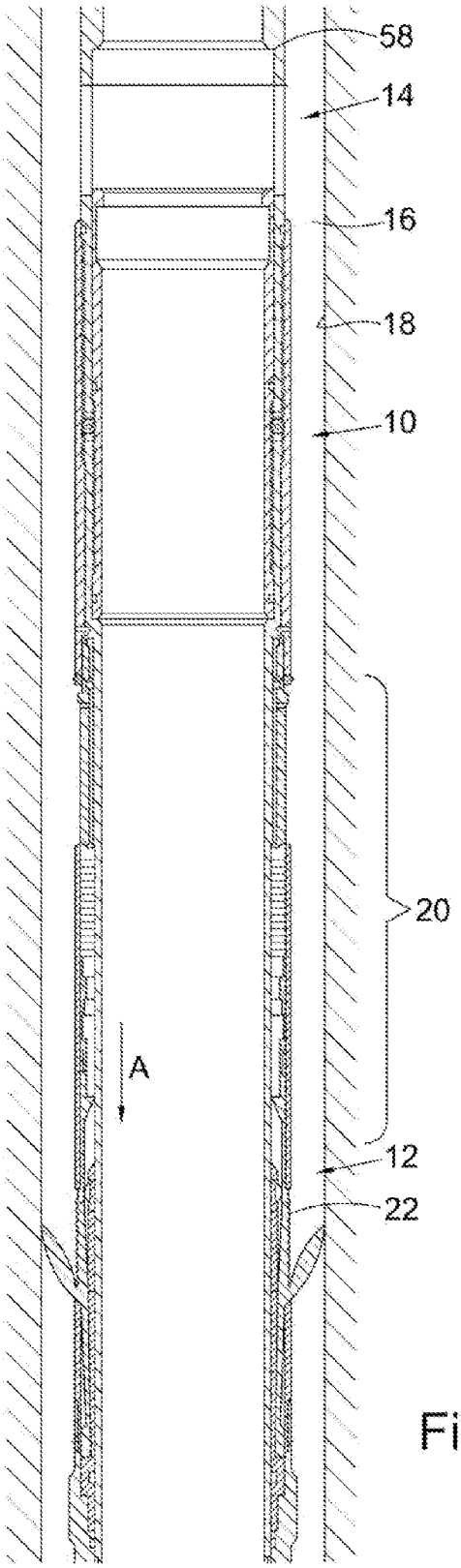
FIG. 1 is a section view of a device for activating a downhole tool, shown connected to a sealing tool, according to a first embodiment of the present invention.

Referring firstly to FIG. 1 there is a shown a section view of a device, generally indicated by reference numeral 10, for activating a downhole tool 12, in this case a packer, according to a first embodiment of the present invention. The device 10 and packer 12 are part of a tool string 14 which extends from a well head (not shown) through a well bore 16. In this case, the well bore 16 is an open hole having a surface 18. The packer 12 comprises a cup seal 22, which is adapted to be expanded from the position shown in solid outline to the position shown in broken outline on FIG. 1. To expand the cup seal 22, a ramp apparatus 20 is provided. The ramp apparatus 20 is adapted to move down the tool string 14 in the direction of arrow A, behind the cup seal 22, expanding the seal element 22.

Figure 2:
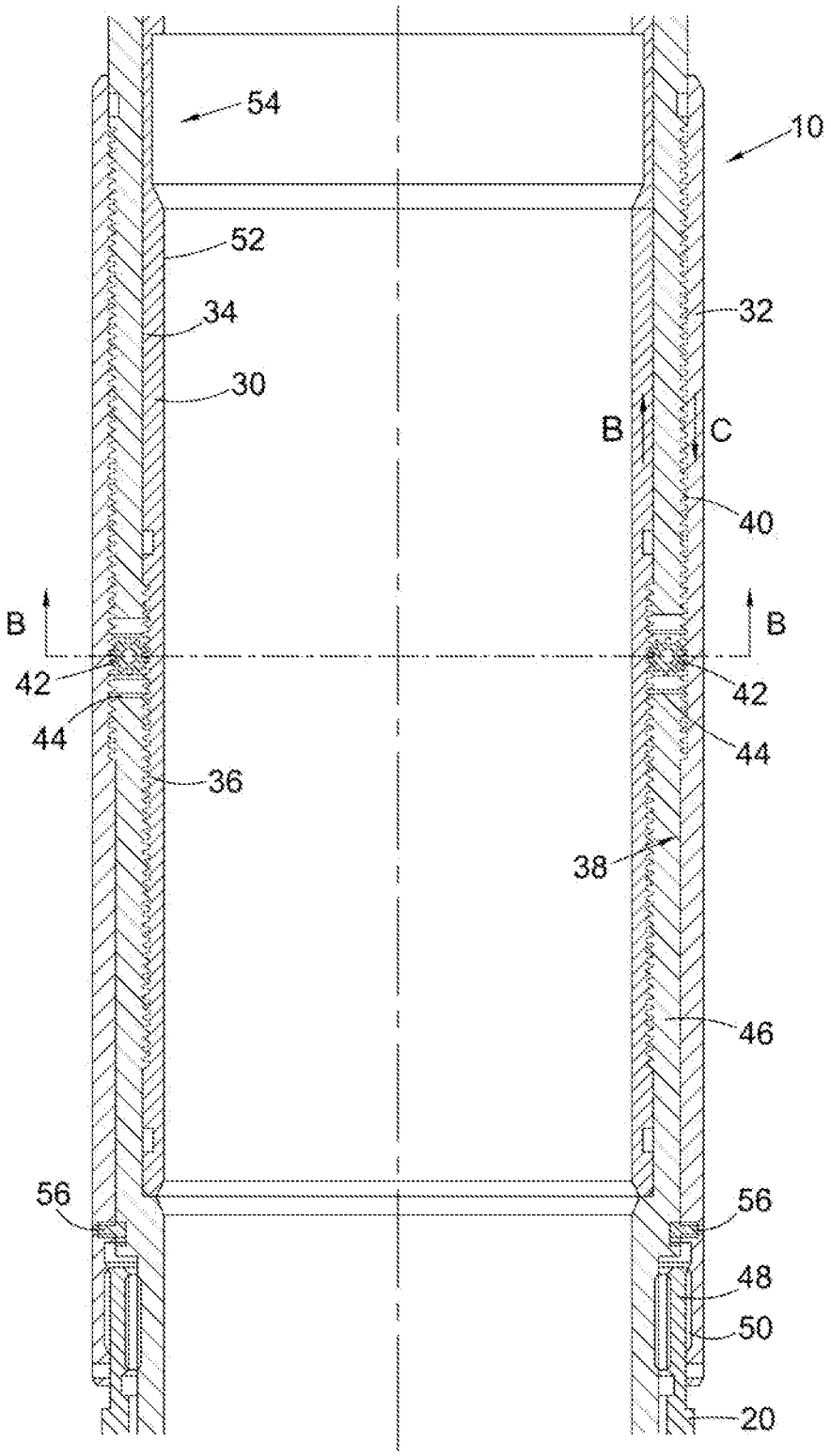
FIG. 2 is a close up section view of the device of FIG. 1.

The ramp apparatus 20 is moved in the direction of arrow A by the activation device 10 which will now be described with reference to FIG. 2, a close up section view of the device 10 of FIG. 1. The device 10 comprises a first elongate tubular member 30 and a second elongate tubular member 32. A portion of the external surface 34 of the first elongate member 30 defines a toothed surface 36. A portion of the internal surface 38 of the second elongate tubular member also defines a toothed surface 40.

The device 10 also comprises six pinions 42 (of which two are visible) located in apertures 44 defined by a tubular pinion support mandrel 46. Therefore, as can be seen from FIG. 1, starting from the inside, the first member 30, the pinion support mandrel 46 and the second tubular member 32 are arranged concentrically.

Each pinion 42 engages both toothed surfaces 36,40 at the same time, such that movement of the first elongate tubular member 30 in the direction of arrow B results in the movement of the second elongate tubular member 32 in the direction of arrow C, opposite to the direction of arrow B. As can be seen from FIG. 2, the second elongate tubular member 32 is connected to the upper end 48 of the ramp apparatus 20 by means of a threaded connection 50. Therefore, movement of the second elongate tubular member 32 results in equal movement of the ramp apparatus 20.

The internal surface 52 of the first elongate tubular member 30 defines a profiled portion 54 adapted to be engaged by a setting tool (not shown). Once engaged an upward pulling force can be applied to the first elongate tubular member, in the direction of arrow B, resulting in movement of the second tubular member 32 and the ramp apparatus 20 in the opposite direction, thereby setting the packer 12.

To prevent inadvertent setting of the seal element 22, the second tubular member 32 is pinned to the pinion support mandrel 46 by six shear pins 56. The force applied by the setting tool (not shown) to the first tubular member 30 must be sufficient to overcome the shear pins 56 before the tubular members 30,32 will move to set the cup seal 22.

Referring back to FIG. 1, over expansion of the cup seal element 22 is prevented by the provision of a mandrel shoulder 58. Upward movement of the first tubular member 30 is restricted by the presence of the shoulder 58. Once the first tubular member 30 engages the shoulder 58, further movement of the tubular members 30,32 is prevented, in turn preventing further movement of the ramp apparatus 20 in the direction of arrow A, the seal setting direction.

Although not shown in any of the Figures, there will generally be two sealing tools each having a sealing element 22 facing in opposite directions. The setting tool can be utilised to first set the lower seal element by applying a simple pull force to the ramp apparatus associated with that seal element. The lower ramp apparatus will move up the tool to set a lower cup seal.

Once set the setting tool can pass up the tool until engagement with the first tubular member profile portion 54 to set the upper sealing element 22.

Figure 3:
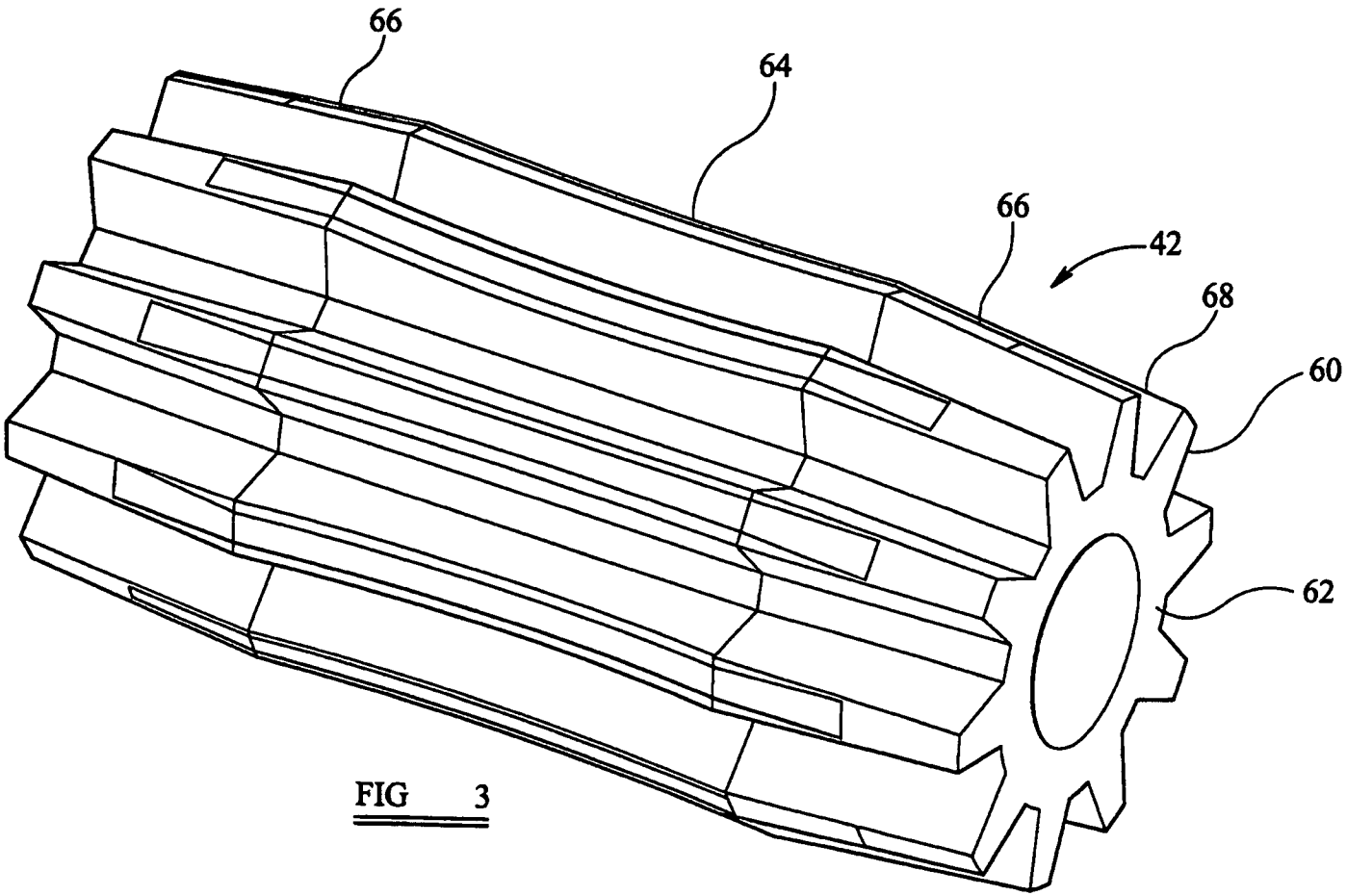
FIG. 3 is a perspective view of one of the pinions of the device of FIG. 1.

The pinions 42 will now be described in more detail, firstly with reference to FIGS. 3 and 4 perspective and side views of a pinion 42 of the device 10 of FIG. 1.

Each pinion 42 comprises a plurality of teeth 60 arranged axially down the length of the pinion body 62. Each tooth 60 comprises a central portion 64 and first and second end portions 66,68.

Figure 4:
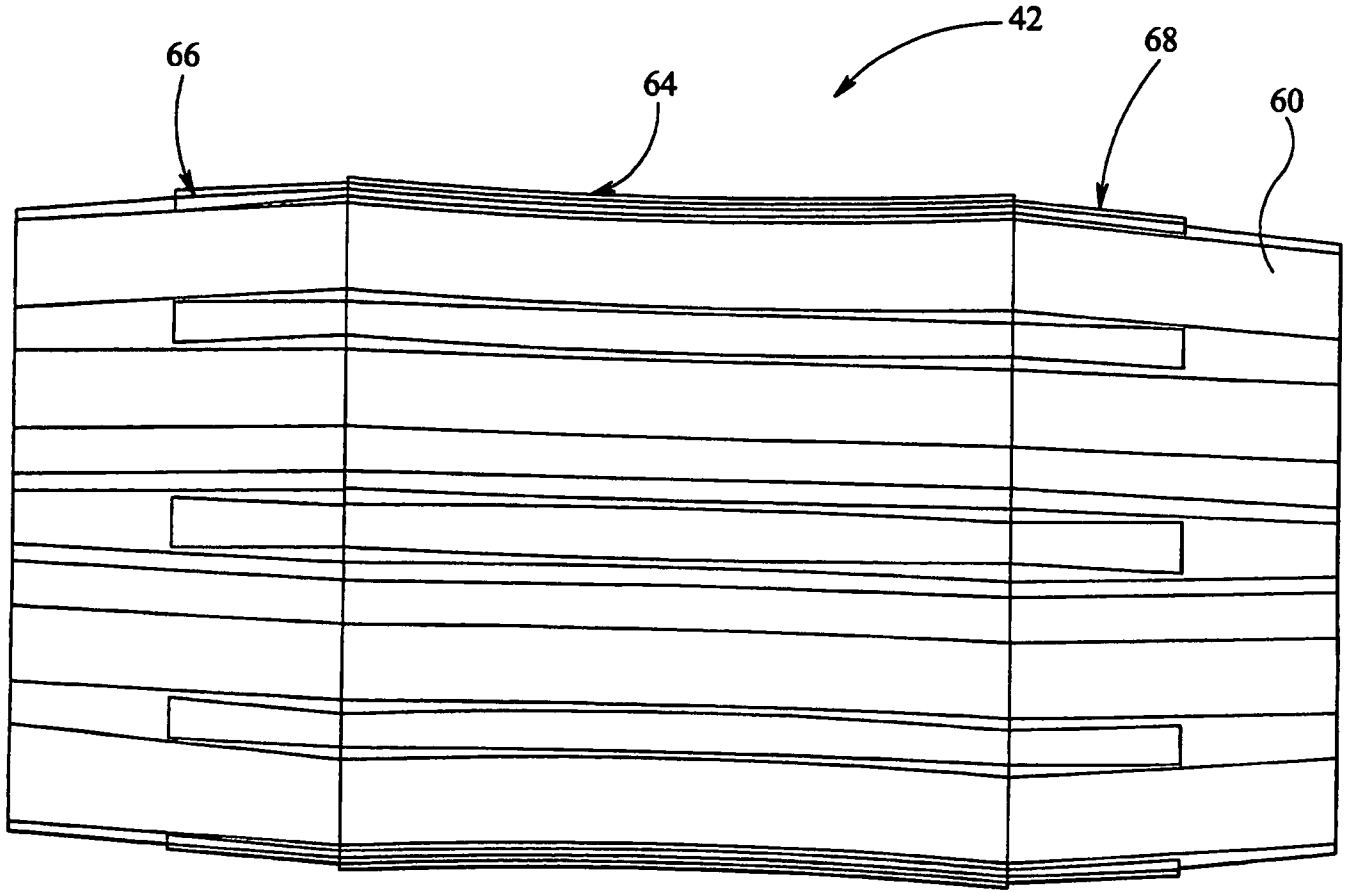
FIG. 4 is a side view of the pinion of FIG. 3.

As can be seen most clearly from FIG. 4, the first and second end portions 66,68 are convex whereas the central portion 64 is concave. This arrangement is adopted to facilitate the meshing of the pinion teeth 60 with the curved tooth surfaces 36,40 of the tubular members 30,32.

This is best explained with reference to FIGS. 5 and 6, FIG. 5 being a section view through section B-B referenced on FIG. 2 and section 6 being a close-up of detail C referenced on FIG. 5. As can be seen from these Figures, and in particular from FIG. 6, the concave central portion 64 of the pinions 42 engage the convex toothed surface 36 of the first elongate tubular member 30. Similarly, the convex end portions 66 engage with the concaved internal toothed surface 40 of the second elongate member 32.

Figure 5:
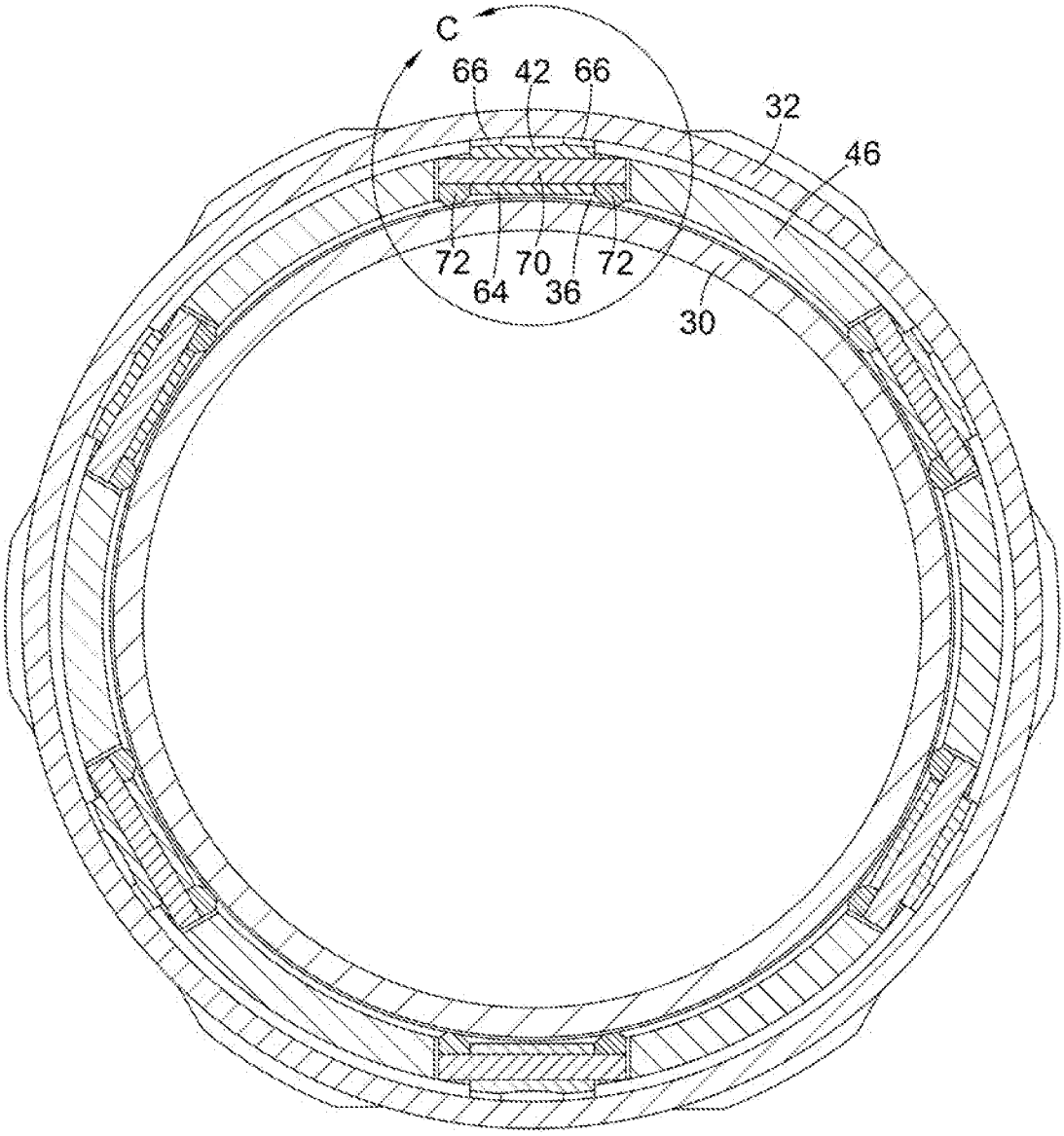
FIG. 5 is a section view through section B-B referenced on FIG. 2.
Figure 6:
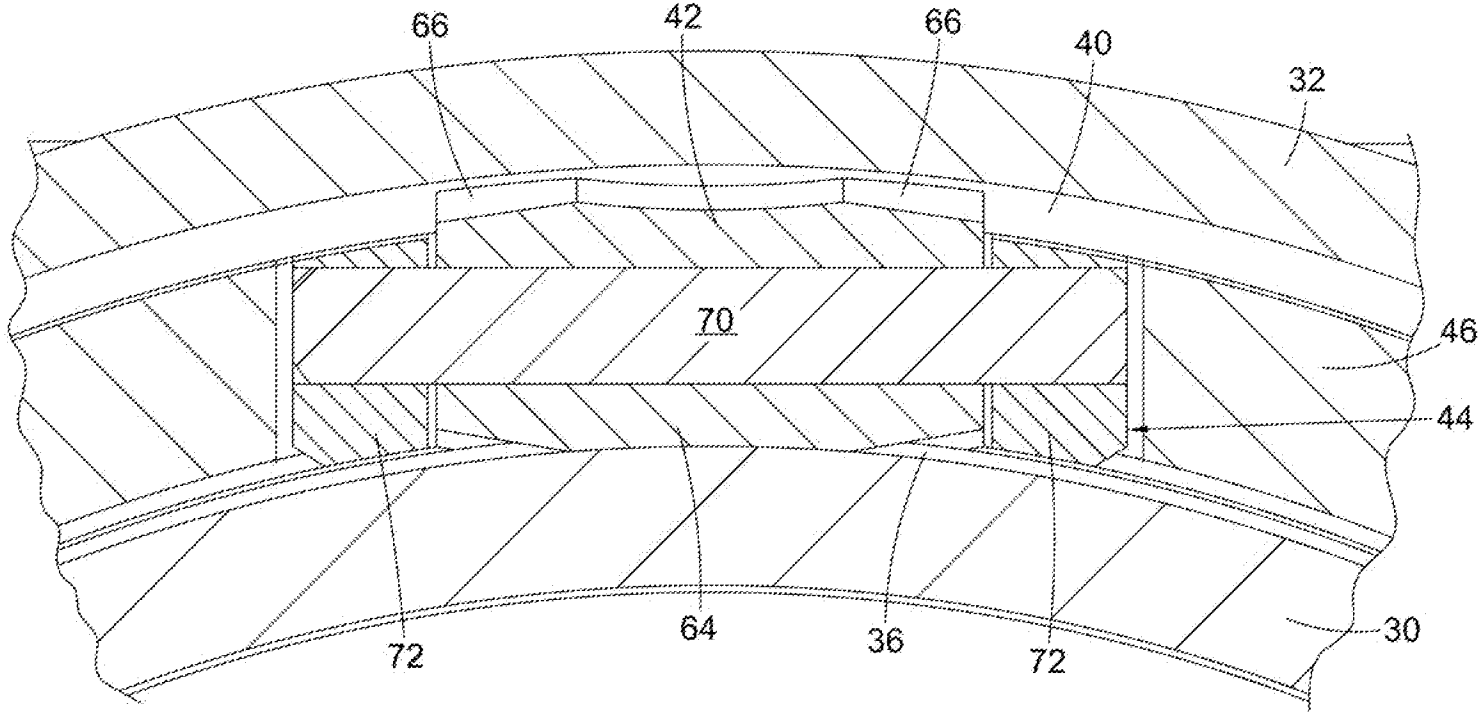
FIG. 6 is a close up view of detail C referenced on FIG. 5.

As can be seen from FIGS. 5 and 6, each pinion 42 is mounted to a journal 70, each journal 70 being axially fixed with respect to the pinion support mandrel 46 by journal bearings 72.

Figure 7:
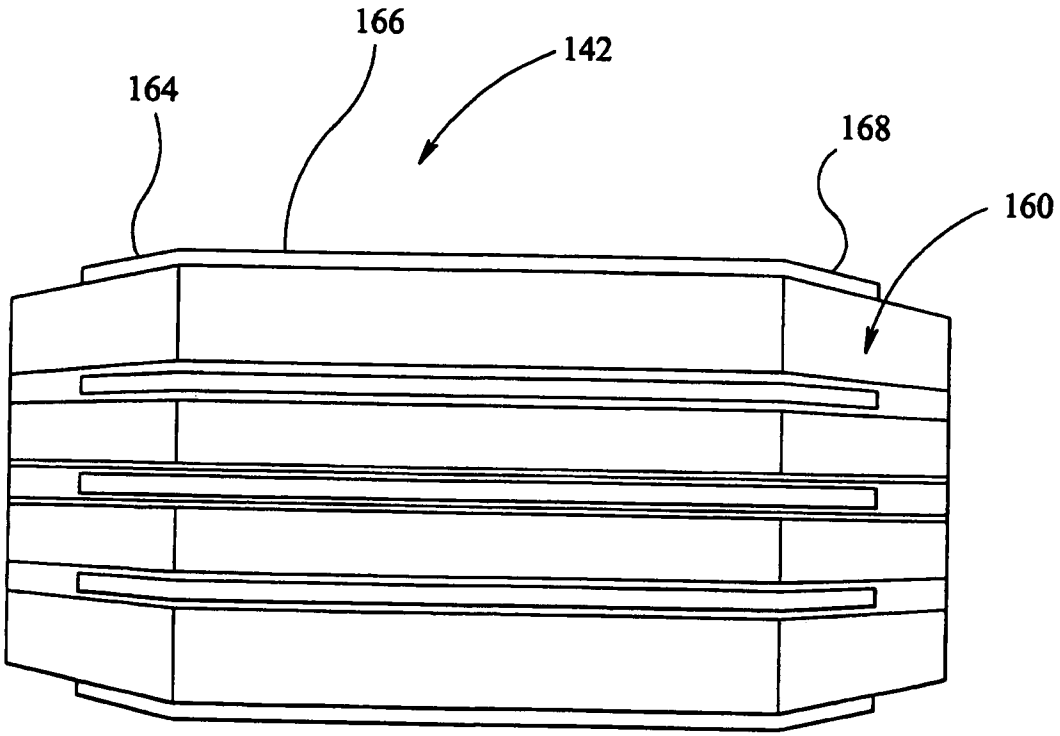
FIG. 7 is a side view of an alternative pinion, according to a second embodiment of the present invention.

Reference is now made to FIG. 7, a side view of an alternative pinion 142, according to a second embodiment of the present invention. The pinion 142 is largely the same as the pinion 42 of the first embodiment with the exception that the central portion 164 and the first and second end portions 166,168 define linear profiles. As shown in FIG. 6, the profiles are angled to each other but this is not necessarily the case. The pinion 142 operates with the other components of the activation device in the same way as the pinion 42.

Various modifications and improvements may be made to the fore-described embodiment before departing from the scope of the invention. For example, although six pinions are used, any suitable number of pinions could be adopted.

Furthermore, each pinion could be replaced by two meshing gears such that the input movement applied to the first tubular member could result in a greater or lesser output movement of the second tubular member. Alternatively, each pinion could comprises two regions, one for meshing with the first tubular and one for meshing with the second tubular, each region having a different number of teeth, which would also result in a greater or lesser output movement of the second tubular member for a given input movement of the first tubular.

It will also be understood that although the setting of a cup seal is described, the activation device is suitable for activating other tools which require a downhole force to be applied for activation.

The invention claimed is:

1. A device for activating a downhole tool, the device comprising:

a first, inner, elongate member defining a toothed surface portion, the first elongate member being tubular and open at both ends;

a second, outer, elongate member defining a toothed surface portion; and a pinion arrangement, the pinion arrangement engaging the toothed surface portions of the first and second elongate members such that movement of one of the first and second elongate members in a first longitudinal direction results in movement of the other of the first and second elongate members in a second longitudinal direction, opposite the first direction.

2. The device of claim 1, wherein the second elongate member is tubular.

3. The device of claim 1, wherein the first elongate member external diameter is less than the second elongate member internal diameter.

4. The device of claim 1, wherein the first elongate member toothed surface portion is defined by an external surface.

5. The device of claim 1, wherein the second elongate member toothed surface portion is defined by an internal surface.

6. The device of claim 1, wherein the teeth on each toothed surface portion are arranged transverse to the direction of movement of the toothed surface portions.

7. The device of claim 1, wherein the toothed surface portions are opposed.

8. The device of claim 1, wherein the pinion arrangement is positioned between the first and second elongate members.

9. The device of claim 1, wherein the pinion arrangement comprises a single pinion.

10. The device of claim 9, wherein the pinion comprises an at least one first pinion region and an at least one second pinion region, the at least one first and second pinion regions being arranged axially along a length of a pinion body.

11. The device of claim 10, wherein the number of teeth on the at least one first pinion region is different to the number of teeth on the at least one second pinion region.

12. The device of claim 10, wherein the teeth of the at least one first pinion region define a convex profile and the teeth of the at least one second pinion region define a concave profile.

13. The device of claim 1, wherein the pinion arrangement comprises a plurality of pinions.

14. The device of claim 13, wherein, where the pinion arrangement comprises a plurality of pinions, at least some of the pinions rotate around the same journal.

15. The device of claim 1, wherein the pinion arrangement comprises at least one pinion, each pinion comprises at least one pinion tooth arranged axially along a length of a pinion body, and each pinion tooth defines a tooth profile comprising a plurality of portions along the length of the pinion body.

16. The device of claim 15, wherein the profile of each tooth portion is linear.

17. The device of claim 16, wherein at least one of said linear profiled tooth portions is adapted to mesh with the first elongate member toothed surface portion.

18. The device of claim 16, wherein at least one other of said linear profiled tooth portions is adapted to mesh with the second elongate member toothed surface portion.

19. The device of claim 16, wherein adjacent linear profiled tooth portions are angled with respect to each other.

20. The device of claim 15, wherein each pinion tooth defines a tooth profile comprising a plurality of linear tooth portions, adjacent linear tooth portions being angled with respect to one another.

21. The device of claim 15, wherein at least one pinion defines a profile comprising at least one convex portion and at least one concave portion.

22. The device of claim 21, wherein the at least one concave portion is adapted to mesh with the first elongate member toothed surface portion.

23. The device of claim 21, wherein the least one convex portion is adapted to mesh with the second elongate member toothed surface portion.

24. The device of claim 21, wherein each pinion tooth defines a profile comprising at least one convex portion and at least one concave portion.

25. The device of claim 1, wherein the pinion arrangement is adapted to rotate around a journal.

26. The device of claim 25, wherein the journal is fixed with respect to the first and second elongate members.

27. The device of claim 1, wherein movement of one of the first and second elongate members equates to an equal movement of the other of the first and second elongate members.

28. The device of claim 1, further comprising a pinion support adapted to support the pinion arrangement.

29. The device of claim 28, wherein the pinion support defines at least one aperture, the at least one aperture adapted to receive a pinion of the pinion arrangement.

30. The device of claim 28, wherein the pinion support is a tubular.

31. The device of claim 28, wherein the first elongate member, the pinion support and the second elongate member are arranged concentrically.

32. The device of claim 28, wherein the pinion support has an internal diameter greater than the external diameter of the first elongate member.

33. The device of claim 28, wherein the pinion support has an external diameter less than the internal diameter of the second elongate member.

34. The device of claim 28, wherein the first and second elongate members are adapted to move axially with respect to the pinion support.

35. The device of claim 1, wherein there are a plurality of the pinion arrangements.

36. The device of claim 1, wherein there are six of the pinion arrangements.

37. The device of claim 1, wherein one of the first or second elongate members is adapted to be engaged by a setting tool.

38. The device of claim 37, wherein the first elongate member is adapted to be engaged by the setting tool.

39. The device of claim 1, wherein one of the first or second elongate members is adapted to engage a packer.

40. A method of activating a tool, the method comprising the steps of:

applying a force to a first, inner, elongate member defining a toothed surface portion to move said first elongate member in a first longitudinal direction, the inner elongate member being tubular and open at both ends, movement of the first elongate member rotating at least one pinion arrangement, rotation of the at least one pinion arrangement moving a second, outer, elongate member defining a toothed surface portion in a second longitudinal direction opposite the first direction, movement of the second elongate member activating a tool.

41. A device for activating a downhole tool, the device comprising:

a first elongate member defining a toothed surface portion;

a second elongate member defining a toothed surface portion; and at least one pinion arrangement, the/each pinion arrangement engaging the toothed surface portions of the first and second members such that movement of one member in a first direction results in movement of the other member in a second direction, opposite the first direction, wherein the pinion arrangement is positioned between the first and second elongate members, wherein at least one pinion tooth defines a tooth profile comprising a plurality of portions, wherein the profile of each tooth portion is linear, and wherein adjacent linear profiled tooth portions are angled with respect to each other.

42. A device for activating a downhole tool, the device comprising:

a first elongate member defining a toothed surface portion;

a second elongate member defining a toothed surface portion; and at least one pinion arrangement, the/each pinion arrangement engaging the toothed surface portions of the first and second members such that movement of one member in a first direction results in movement of the other member in a second direction, opposite the first direction, wherein the pinion arrangement is positioned between the first and second elongate members, wherein at least one pinion tooth defines a tooth profile comprising a plurality of portions, and wherein each pinion tooth defines a tooth profile comprising a plurality of linear tooth portions, adjacent linear tooth portions being angled with respect to one another.

43. A device for activating a downhole tool, the device comprising:

a first elongate member defining a toothed surface portion;

a second elongate member defining a toothed surface portion; and at least one pinion arrangement, the/each pinion arrangement engaging the toothed surface portions of the first and second members such that movement of one member in a first direction results in movement of the other member in a second direction, opposite the first direction, wherein the pinion arrangement is positioned between the first and second elongate members, wherein at least one pinion tooth defines a tooth profile comprising a plurality of portions, and wherein at least one pinion defines a profile comprising at least one convex portion and at least one concave portion.

44. The device of claim 43, wherein the at least one concave portion is adapted to mesh with the first elongate member toothed surface portion.

45. The device of claim 43, wherein the least one convex portion is adapted to mesh with the second elongate member toothed surface portion.

46. The device of claim 43, wherein each pinion tooth defines a profile comprising at least one convex portion and at least one concave portion.

47. A device for activating a downhole tool, the device comprising:

a first elongate member defining a toothed surface portion;

a second elongate member defining a toothed surface portion; and at least one pinion arrangement, the/each pinion arrangement engaging the toothed surface portions of the first and second members such that movement of one member in a first direction results in movement of the other member in a second direction, opposite the first direction, wherein the pinion arrangement is positioned between the first and second elongate members, wherein the pinion arrangement comprises a single pinion, wherein the pinion comprises an at least one first pinion region and an at least one second pinion region, and wherein the teeth of the at least one first pinion region define a convex profile and the teeth of the at least one second pinion region define a concave profile.

* * * * *

UNITED STATES PATENT AND TRADEMARK OFFICE

CERTIFICATE OF CORRECTION

PATENT NO. : 8,689,864 B2
APPLICATION NO. : 12/665641
DATED : April 8, 2014
INVENTOR(S) : Reid It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 719 days.

Signed and Sealed this
Nineteenth Day of May, 2015

Michelle K. Lee

Michelle K. Lee
*Director of the United States Patent and Trademark Office*